US005327876A

United States Patent [19]

Uchida

[11] Patent Number: 5,327,876

[45] Date of Patent: Jul. 12, 1994

[54] AIR-FUEL RATIO CONTROL SYSTEM FOR ENGINES

[75] Inventor: Masaaki Uchida, Yokosuka, Japan

[73] Assignee: Nissan Motor Co., Ltd., Japan

[21] Appl. No.: 961,287

[22] Filed: Oct. 15, 1992

[30] Foreign Application Priority Data

Oct. 21, 1991 [JP] Japan ..... 3-272888

[51] Int. Cl.[5] ..... F02D 41/14

[52] U.S. Cl. ..... 123/674; 123/688

[58] Field of Search ..... 123/674, 688, 690

[56] References Cited

U.S. PATENT DOCUMENTS 5,065,728 11/1991 Nakaniwa ..... 123/688 X 5,179,929 1/1993 Miyashita et al. ..... 123/688

FOREIGN PATENT DOCUMENTS 61-286551 12/1986 Japan ..... 123/688

62-186029 8/1987 Japan .

1-8334 1/1989 Japan ..... 123/688

*Primary Examiner*—Tony M. Argenbright

*Attorney, Agent, or Firm*—Lowe, Price, LeBlanc & Becker

[57] ABSTRACT

This invention relates to an air-fuel ratio control system for an engine which can continuously detect the air-fuel ratio of the air-fuel mixture supplied to the engine using an air-fuel ratio sensor within a wide range including the theoretical air-fuel ratio, and can then, based on the sensor output, perform feedback correction of the air-fuel ratio to the theoretical air-fuel ratio or to another air-fuel ratio. The deterioration of the air-fuel ratio sensor is judged based on the difference between the feedback correction coefficient when feedback control is performed to the theoretical air-fuel ratio, and the feedback correction coefficient when it is performed to another air-fuel ratio. Deterioration of the sensor is thereby detected completely separate from scatter or deterioration of performance of the fuel injector or other components.

2 Claims, 10 Drawing Sheets

AIR-FUEL RATIO CONTROL SYSTEM FOR ENGINES

FIELD OF THE INVENTION

This invention relates to an air-fuel ratio control system of an internal combustion engine and more specifically to a deterioration detector for air-fuel ratio sensors used in such a system.

BACKGROUND OF THE INVENTION

In air-fuel ratio (hereinafter referred to as AFR) control systems using an AFR sensor for continuously detecting AFR from the oxygen concentration of the exhaust gas, an air-fuel mixture can be obtained having any AFR over a wide range. This AFR includes, but is not limited to, the theoretical AFR.

For this purpose, a basic fuel injection amount is determined according to the engine load and speed, and the fuel injected from a fuel injector is feedback corrected based on the difference between a real AFR detected by the AFR sensor and a target AFR.

In this type of AFR control system the precision of the AFR sensor is of vital importance, and if it deteriorates, the precision of AFR control is also poorer.

A method of detecting AFR sensor deterioration is disclosed in, for example, Tokkai Sho 62-186029 published by the Japanese Patent Office.

According to this detection method, it is judged whether or not a feedback correction coefficient computed from the difference between the output of the AFR sensor and a target AFR is within a predetermined range. If the value of this coefficient lies outside this range, it is judged that the AFR sensor has deteriorated.

However, the feedback correction coefficient may lie outside the predetermined range due not only to deterioration of the AFR sensor, but also to other factors such unevenness or deterioration in the performance of the fuel injector or the air flow sensor which detects the intake air volume of the engine. Using this method, therefore, there was a possibility that the AFR sensor was judged to have deteriorated even when it had not deteriorated.

SUMMARY OF THE INVENTION

It is therefore an object of this invention to accurately judge deterioration of an AFR sensor.

It is a further object of this invention to perform this judgement in the AFR control process.

In order to achieve the above objects, this invention provides an air-fuel ratio control system for an engine provided with an air-fuel ratio sensor for continuously detecting air-fuel ratio of an air-fuel mixture supplied to the engine over a wide range including the theoretical air-fuel ratio, and a device for feedback correcting the air-fuel ratio of the air-fuel mixture to a preset target ratio based on the air-fuel ratio detected by the sensor.

This control system comprises a device for setting the target air-fuel ratio to the theoretical air-fuel ratio, a device for setting the target air-fuel ratio to an air-fuel ratio other than the theoretical air-fuel ratio, and a device for judging the deterioration of the sensor based on the difference between the feedback correction amount when the target air-fuel ratio is the theoretical air-fuel ratio and the feedback correction amount when the target air-fuel ratio is the other air-fuel ratio.

Alternatively, the control system comprises a device for setting the target air-fuel ratio to the theoretical air-fuel ratio, a device for setting the target air-fuel ratio to an air-fuel ratio other than the theoretical air-fuel ratio, a device for learning a feedback correction amount corrected by the feedback correcting device, a device for computing a learning correction amount based on the learned feedback correction amount, a device for correcting the previous air-fuel ratio of the air-fuel mixture based on the learning correction amount, and a device for judging the deterioration of the sensor based on the difference between the learning correction amount when the target air-fuel ratio is the theoretical air-fuel ratio and the learning correction amount when the target air-fuel ratio is the other air-fuel ratio.

It is preferable that the learning correction amount computation device determines the learning correction amount based on a deviation of the average value of the feedback correction amount.

The details as well as other features and advantages of this invention are set forth in the remainder of the specification and are shown in the accompanying drawings.

DESCRIPTION OF THE PREFERRED EMBODIMENTS

Figure 1:
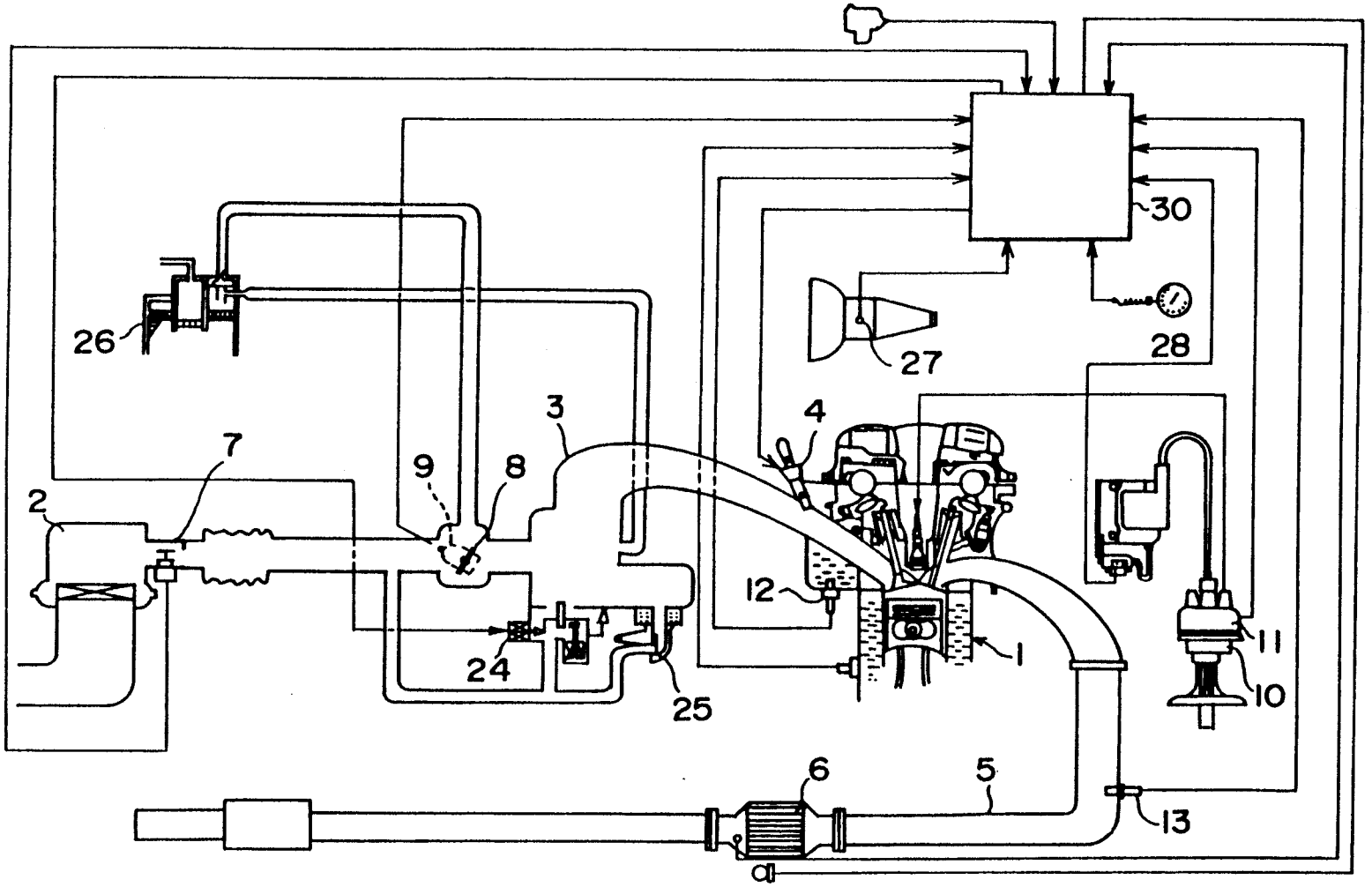
FIG. 1 is a schematic diagram of an AFR control system according to this invention.

Referring to FIG. 1 of the drawings, air aspirated by an engine 1 of a vehicle is introduced from an air cleaner 2 via an intake passage 3, and fuel is injected toward an intake port from a fuel injector 4 provided in each cylinder of the engine 1.

Gas burnt in the engine 1 is introduced via an exhaust passage 5 into a catalytic converter 6 where toxic components of the burnt gas (CO, HC, NOx) are eliminated.

The intake air volume is detected by a hot wire type air flow sensor 7, this volume being controlled by a throttle valve 8 which operates in conjunction with the accelerator pedal of the vehicle.

The opening of the throttle valve 8 is detected by a throttle opening sensor 9. Engine speed is detected by a crank angle sensor 11 installed in a distributor 10, and the temperature of cooling water in a water jacket of the engine 1 is detected by a water temperature sensor 12.

A neutral switch 27 detects the neutral position of the transmission gear system of the vehicle, and a speed sensor 28 detects the speed of the vehicle.

The oxygen concentration of the exhaust gas from the engine 1, directly corresponds to the AFR of the air-fuel mixture supplied to the engine 1. An AFR sensor 13 installed in the exhaust pipe 5 detects the AFR of the engine 1 from the oxygen concentration in the exhaust pipe 5. The AFR sensor 13 has characteristics which enable it to detect the AFR over a wide range from rich to lean.

Figure 2:
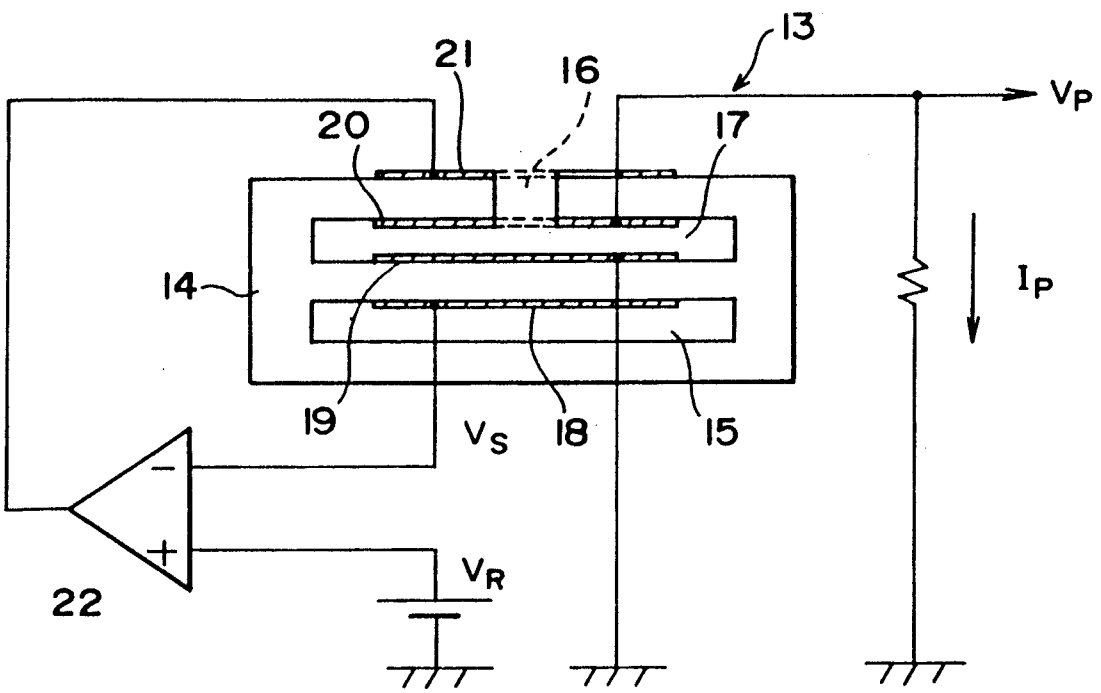
FIG. 2 is a circuit diagram of an AFR sensor used for the AFR control system.

This AFR sensor 13, as shown in FIG. 2, comprises an atmospheric chamber 15 and a diffusion chamber 17 enclosed by an oxygen ion conducting electrolyte 14 such as zirconia. Exhaust gas is introduced via a throughhole 16 into the diffusion chamber 17, and porous platinum electrodes 18–21 are formed by coating on the inner and outer wall surfaces of the diffusion chamber 17.

When a current is passed between the electrodes 20 and 21 which are disposed on either side of the solid electrolyte 14, oxygen ions move between the electrodes through the electrolyte 14 in an opposite direction to the current. The current is then directly proportional to the partial pressure of oxygen in the exhaust gas in the vicinity of the electrode 20.

The electrodes 18 and 19 disposed in a similar fashion on either side of the solid electrolyte 14 detect the aforesaid partial pressure, and the electrode 18 outputs a corresponding voltage VS.

This voltage VS and a reference voltage VR are input to a differential amplifier 22. When the output of this amplifier 22 is connected to the electrode 21, a current IP flows between the electrode 20 and the ground of which the direction and value vary according to the difference between the partial pressure of oxygen in the exhaust gas and the partial pressure of oxygen in the vicinity of the electrode 20. By measuring this current IP, therefore, the partial pressure of oxygen in the exhaust gas can be detected.

The engine 1 is provided also with an idle air control valve 24 which controls the intake air volume when the engine is idling, an air regulator 25 for increasing the intake air volume in a cold engine operation, and a canister 26 for introducing vaporized fuel in the fuel tank into the engine 1, and burning it.

Signals from the air flow sensor 7, throttle opening sensor 9, crank angle sensor 11, water temperature sensor 12, AFR sensor 13, neutral switch 27 and speed sensor 28 are input to a control unit 30 together with the signal from the ignition switch of the vehicle.

Figure 3:
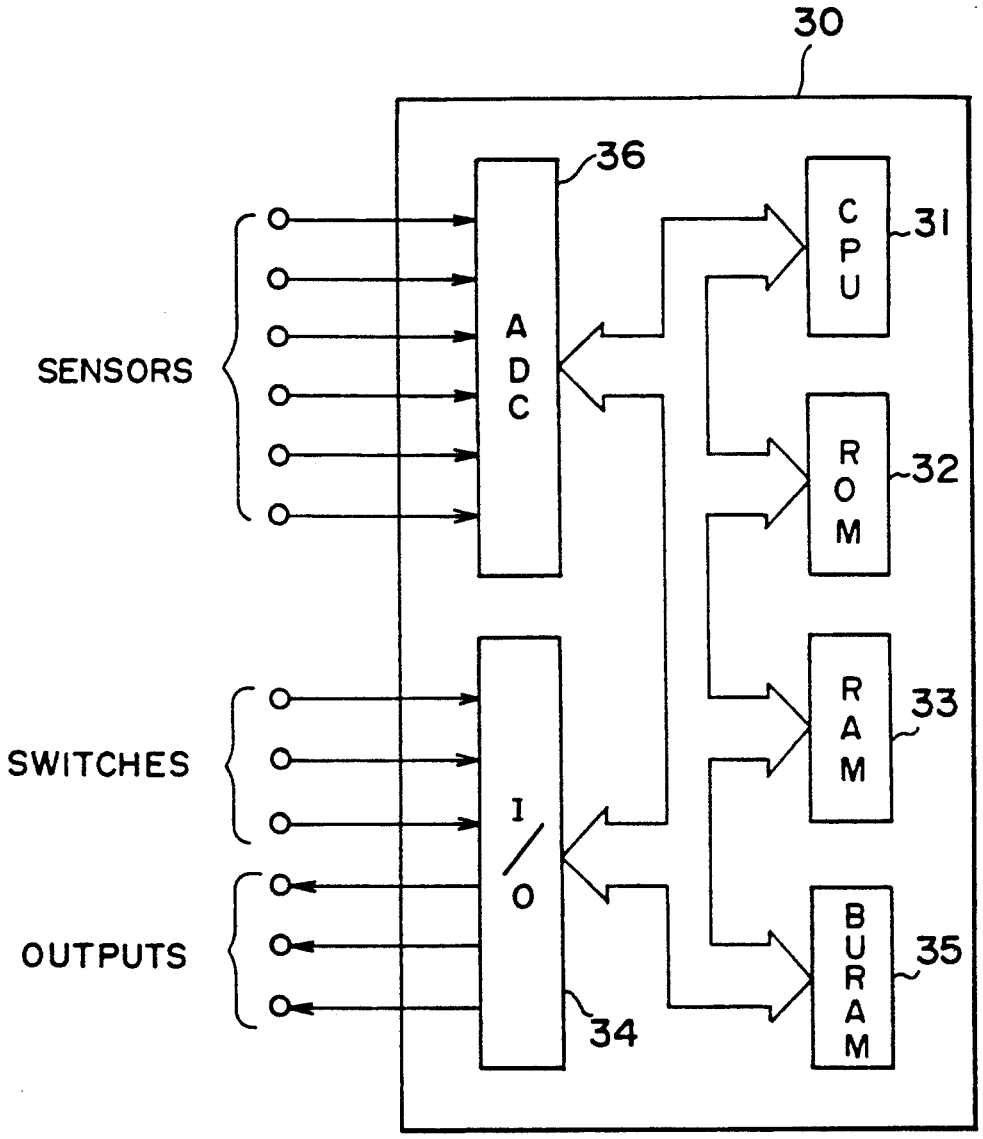
FIG. 3 is a block diagram of a control unit according to this invention.

As shown in FIG. 3, the control unit 30 comprises a microprocessor consisting of a CPU 31, ROM 32, RAM 33, interface (I/O) 34, back-up RAM (BURAM) 35 and A/D converter (ADC) 36. This control unit 30 controls the fuel amount injected from the fuel injector 4 according to the aforesaid signals, and also judges deterioration of the AFR sensor 13.

The operations of the control unit 30 will now be described with reference to the flowcharts of FIG. 4–FIG. 9.

First, a fuel injection pulse width Ti which represents the fuel amount to be injected by the fuel injector 4 is computed by means of the relation:

$$Ti = Tp \times COEF \times TDML \times \alpha \times L\alpha + Ts$$

wherein Tp is a basic injection pulse width. Tp is calculated from the relation:

$$Tp = Kc \times Qa/Ne$$

wherein Qa is the intake air volume, Ne is the engine speed and Kc is a constant.

COEF is the sum of various correction coefficients determined according to the engine running conditions, e.g. engine speed, water temperature and the elapsed time after the ignition switch is turned on. These coefficients are read from predetermined tables.

TDML is a set value of an AFR given by the expression theoretical AFR/target AFR.

$\alpha$ is a feedback correction coefficient of the AFR determined according to the difference of the output from the AFR sensor 13 (real AFR) and the target AFR, and $L\alpha$ is a learning control coefficient learned from the feedback correction coefficient $\alpha$.

Ts is an ineffectual pulse width.

The control unit 30 outputs a pulse signal corresponding to this injection pulse width Ti to the fuel injector 4, and thereby controls the fuel injection amount, i.e. the AFR.

Figure 4:
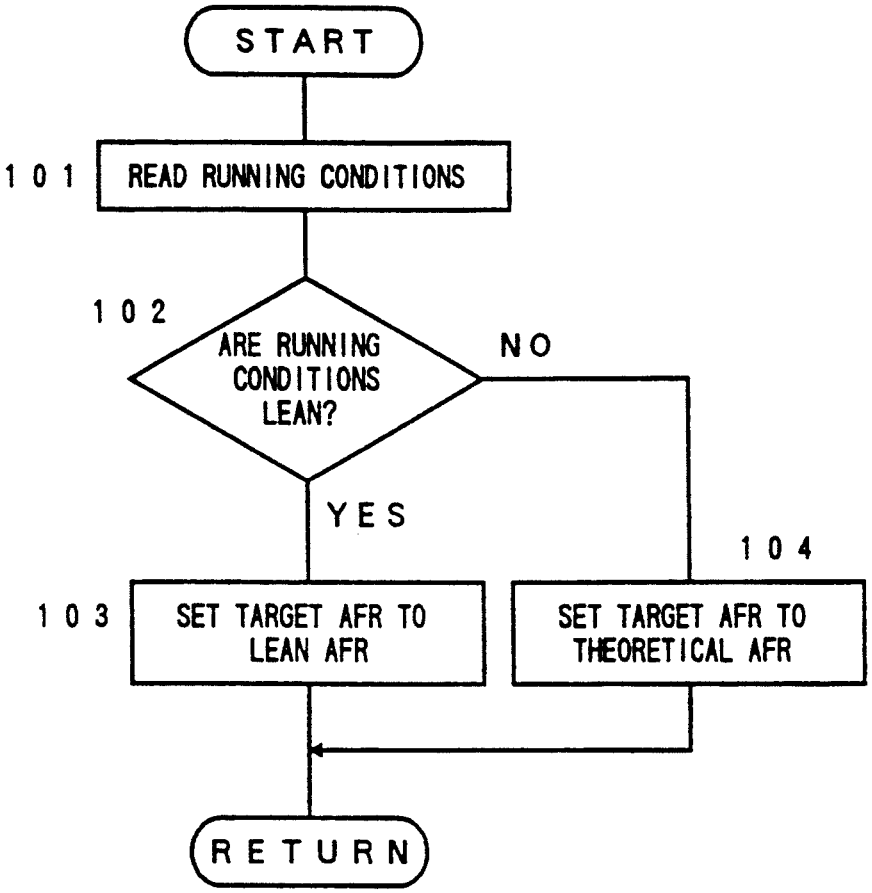
FIG. 4 is a flowchart of an AFR setting process performed by the control unit.

FIG. 4 is a flowchart for setting the target AFR. In a step 101, running conditions such as the intake air volume Qa, engine speed Ne and water temperature Tw are read, and in a step 102, it is judged whether or not the running conditions are suitable for setting a lean AFR.

When the engine is not cold and the load is light for example, the program proceeds to a step 103, the target AFR is set to a lean AFR, i.e. a lean value is assigned to the aforesaid TDML, and the engine begins running at a lean AFR.

If the running conditions are unsuitable for setting a lean AFR, the program proceeds to a step 104, the target AFR is set to the theoretical AFR and the engine begins running at the theoretical AFR.

Figure 5:
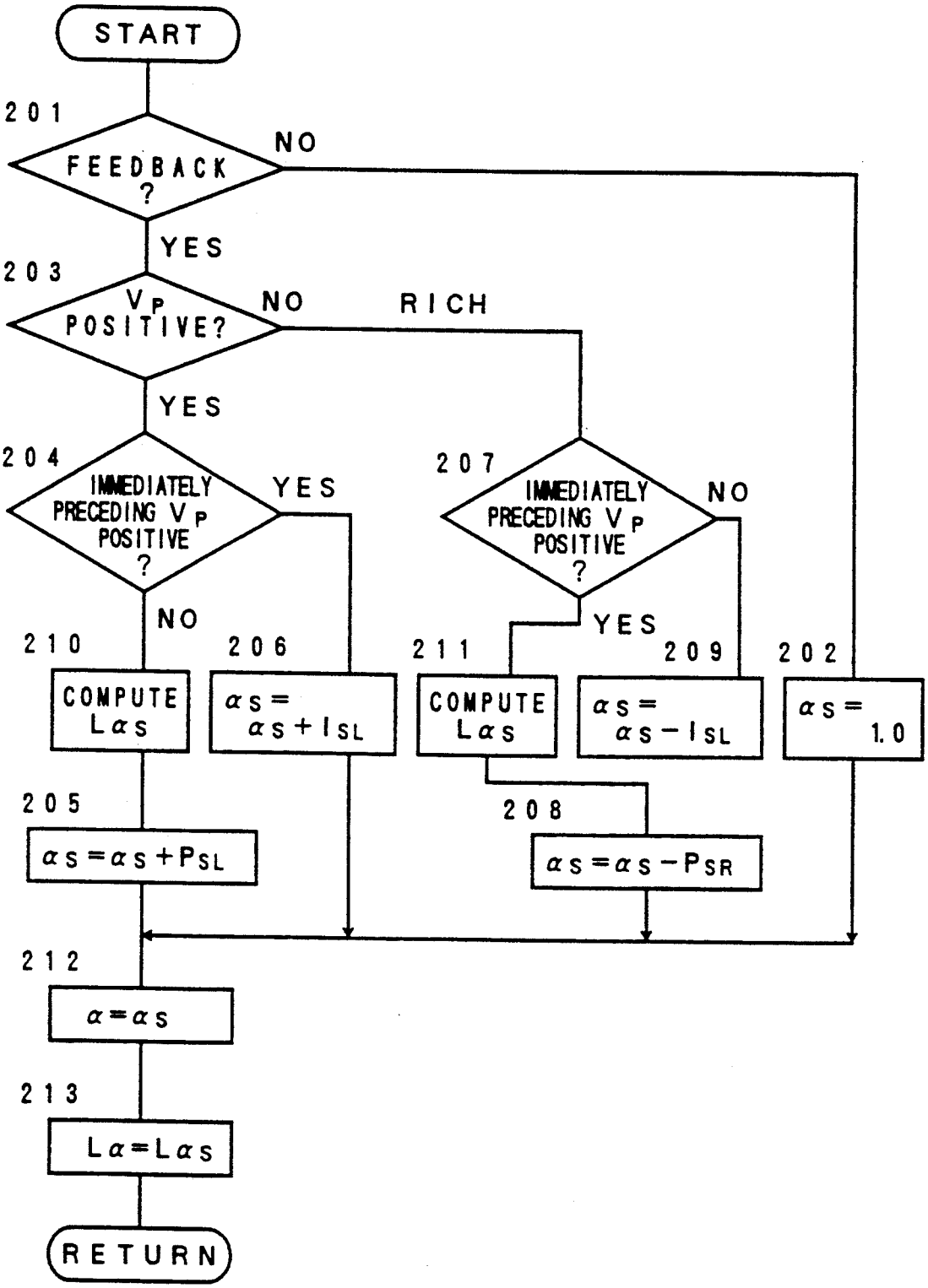
FIG. 5 is a flowchart of a theoretical AFR control process performed by the control unit.
Figure 6:
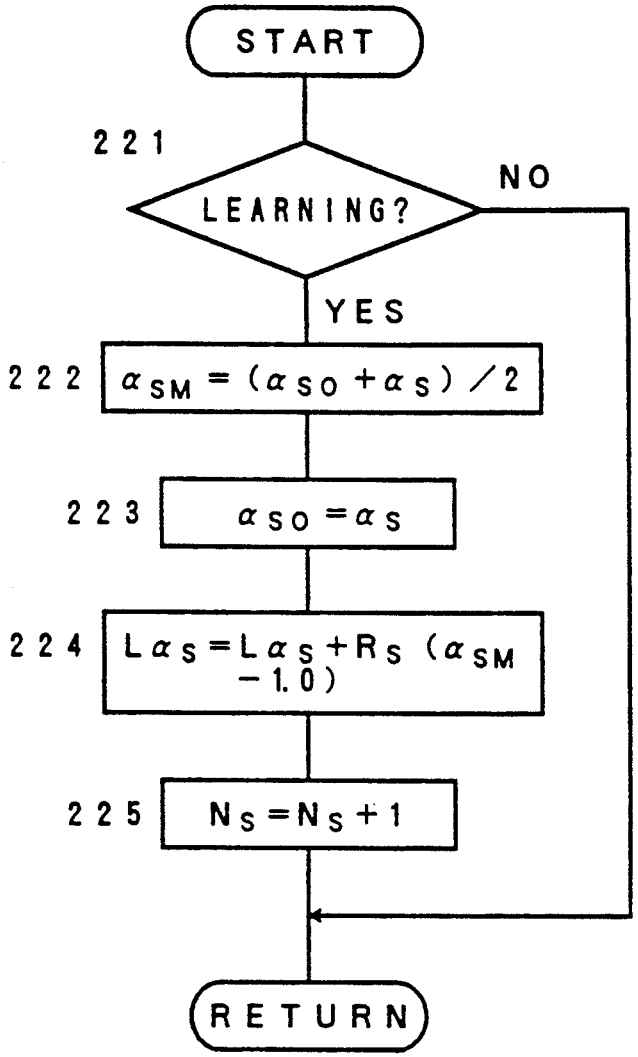
FIG. 6 is a flowchart of a learning process in the theoretical AFR control.

When the engine begins running at the theoretical AFR, a feedback correction coefficient $\alpha S$ and learning control coefficient $L\alpha S$ are computed according to the flowcharts of FIGS. 5 and 6. AFR feedback control and learning control are then performed.

In FIG. 5, in a step 201, it is judged from the running conditions whether the engine is within a feedback control area which excludes for example when the engine is cold, the period immediately after start-up, when the engine is ticking over and when the throttle is fully open. If it is judged that the engine 1 is within the feedback control area, control subsequent to a step 203 is performed. If it is judged in the step 201 that the engine is not within the feedback control area, the feedback control coefficient $\alpha S$ is set to 1 and feedback control is not performed.

If the engine is within the feedback control area, and the output VP of the AFR sensor 13 changes from negative (rich) to positive (lean) in the step 203 and a step 204, a predetermined proportional fraction PSL is added to the coefficient $\alpha S$ on the immediately preceding occasion in a step 205. On all subsequent occasions, a predetermined integral fraction ISL is added to the correction coefficient $\alpha S$ in a step 206, and this continues until the output VP changes to negative.

When the output VP of the AFR sensor 13 changes from positive to negative in any of the steps from 203 to 207, a predetermined proportional fraction PSR is subtracted from the correction coefficient $\alpha S$ on the immediately preceding occasion in a step 208. On all subsequent occasions, a predetermined integral fraction ISR is subtracted from the correction coefficient αS in a step 209, and this continues until the output VP changes to positive.

In order to prevent unnecessary control of negligible fluctuation, the output VP is allowed a width which takes account of hysteresis when judging whether the output VP is positive or negative.

The feedback correction coefficient αS is thus found using proportional integral fractions.

Whenever the output VP of the AFR sensor 13 changes from positive to negative or from negative to positive, therefore, a learning control coefficient LαS is computed in a step 210 or 211.

This computation is shown by the flowchart of FIG. 6.

In FIG. 6, in a step 221, it is first judged whether or not the conditions are suitable for performing learning control, such as for example whether or not the output of the AFR sensor 13 is sampled several times, while the basic pulse width Tp and engine speed Ne which depend on the load of the engine 1 are within a predetermined region. If not, no learning operations are executed and the routine is terminated.

If the conditions are suitable, in a step 222, the average value α SM of the feedback correction coefficients α SO and α S is calculated. α SO is the coefficient when the output of the AFR sensor 13 on the immediately preceding occasion has changed from positive to negative or negative to positive. α S is the coefficient when the output of the AFR sensor 13 on the present occasion has changed from negative to positive or positive to negative.

Next, in a step 224, the deviation of the average α SM is multiplied by a weighting coefficient RS, and added to the learned value on the immediately preceding occasion so as to calculate a new learning coefficient Lα S.

Also, in a step 225, a number of learning times NS is counted.

When the engine is run at the theoretical AFR, AFR feedback control and learning control are performed using this feedback correction coefficient α S(α) and learning control coefficient Lα S(Lα).

Figure 7:
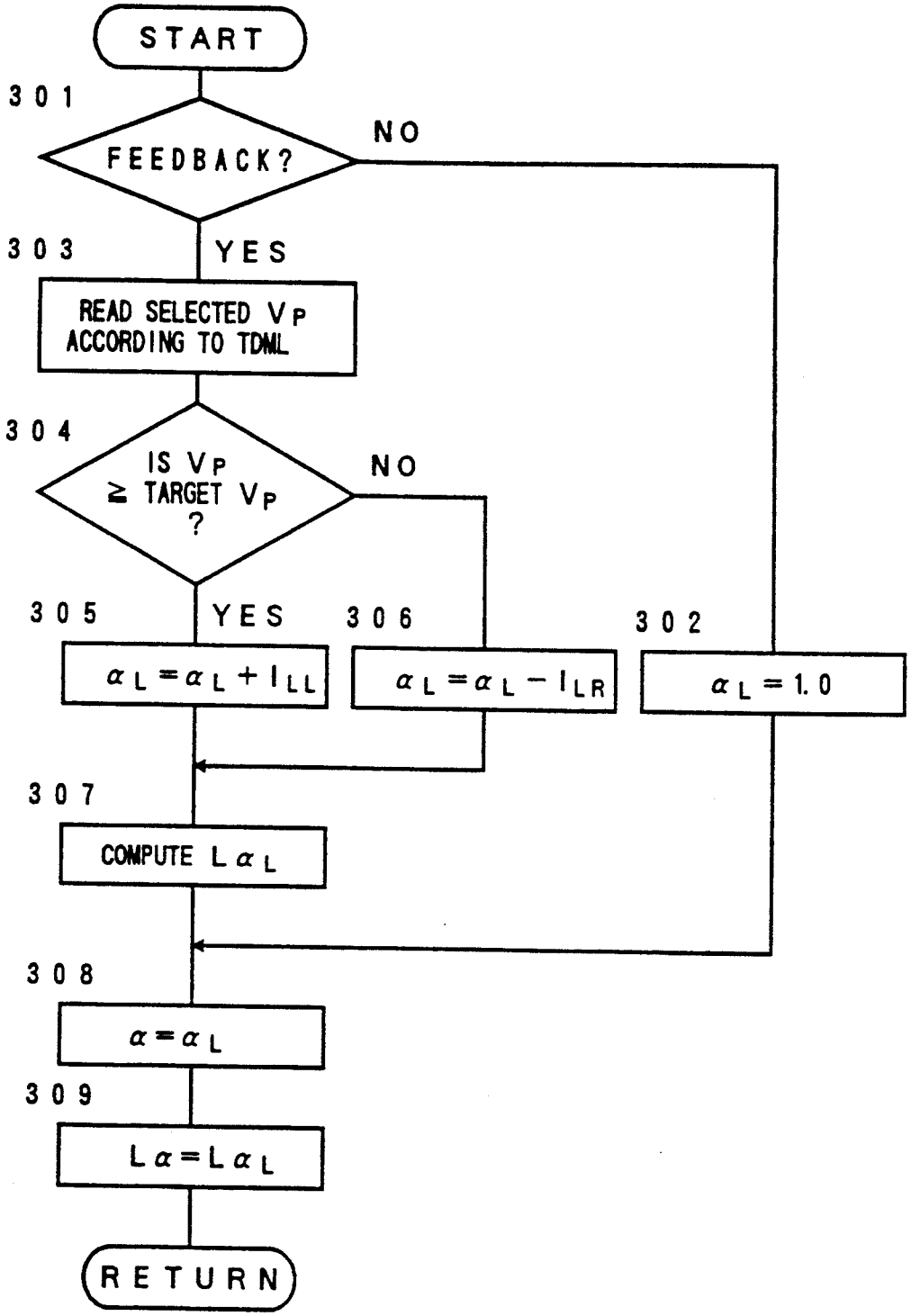
FIG. 7 is a flowchart of a lean AFR control process performed by the control unit.
Figure 8:
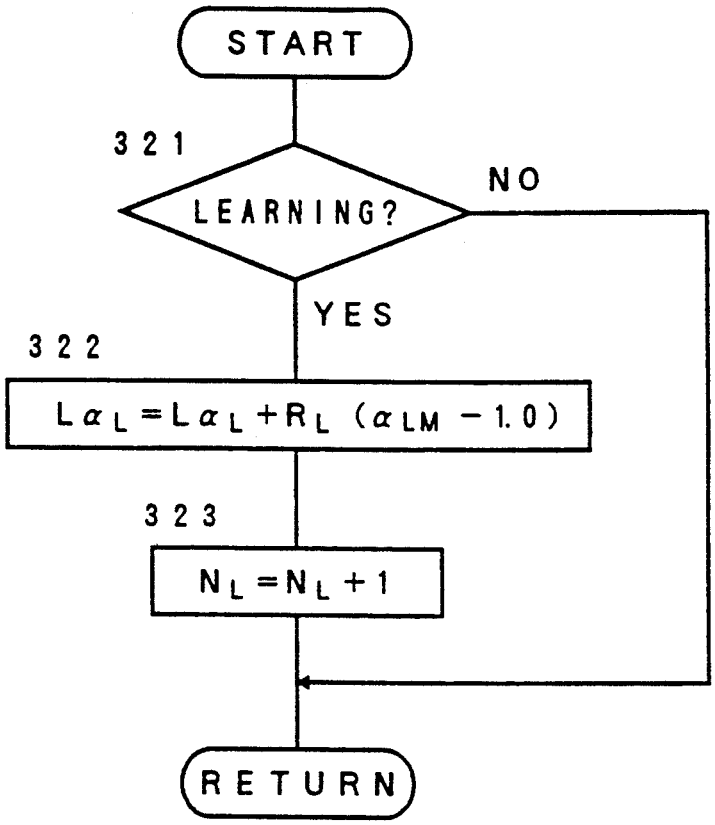
FIG. 8 is a flowchart of a learning process in the lean AFR control.

When the engine is run at a lean AFR, on the other hand, a feedback control coefficient α L and learning control coefficient Lα L are computed based on the flowcharts of FIGS. 7 and 8 in order to perform AFR feedback control and learning control.

In FIG. 7, in the step 301, it is judged whether or not the engine is in the feedback control region. If it is not, the feedback control coefficient α L is set to 1 and feedback control is not performed.

If it is judged that the engine is in the feedback control region, in a step 303, a target VP is set so as to correspond with the value TDML of the lean AFR, and in a step 304, the output VP of the AFR sensor 13 is compared to the target VP.

If the output VP of the AFR sensor 13 is higher than the target VP, the computation of a step 305 wherein a predetermined integral fraction ILL is added to the correction coefficient α L on the immediately preceding occasion is repeated until the output VP decreases to the target VP.

If on the other hand, the output VP of the AFR sensor 13 is lower than the target VP, the computation of a step 306 wherein a predetermined integral fraction ILR is subtracted from the correction coefficient α L on the immediately preceding occasion is repeated until the output VP increases to the target VP.

In order to prevent unnecessary control of negligible small fluctuation, the value of the target VP is allowed a width which takes account of hysteresis when judging whether the output VP has reached the target VP.

The learning control coefficient Lα L is then computed in a step 307 whenever the output VP of the AFR sensor 13 rises above or falls below the target VP. This computation is shown in FIG. 8.

In FIG. 8, in a step 321, it is judged whether or not the conditions are suitable for performing learning control, such as for example whether or not the output of the AFR sensor 13 is sampled several times while the basic pulse width Tp and engine speed Ne which depend on the load of the engine 1 are within a predetermined region. If not, no learning operations are executed and the routine is terminated.

If the conditions are suitable, in a step 322, the average value α LM of the feedback correction coefficient α L (average of value when the output of the AFR sensor 13 has risen above the target VP, and value when it has fallen below the target VP) is calculated, the deviation of this average α LM is multiplied by a weighting coefficient RL, and is then added to the learned value on the immediately preceding occasion so as to calculate a new learning coefficient Lα L. Also, in a step 323, a number of learning times NL is counted.

When the engine is run at a lean AFR, AFR feedback control and learning control are performed using this feedback correction coefficient α L(α) and learning control coefficient Lα L (Lα).

Figure 9:
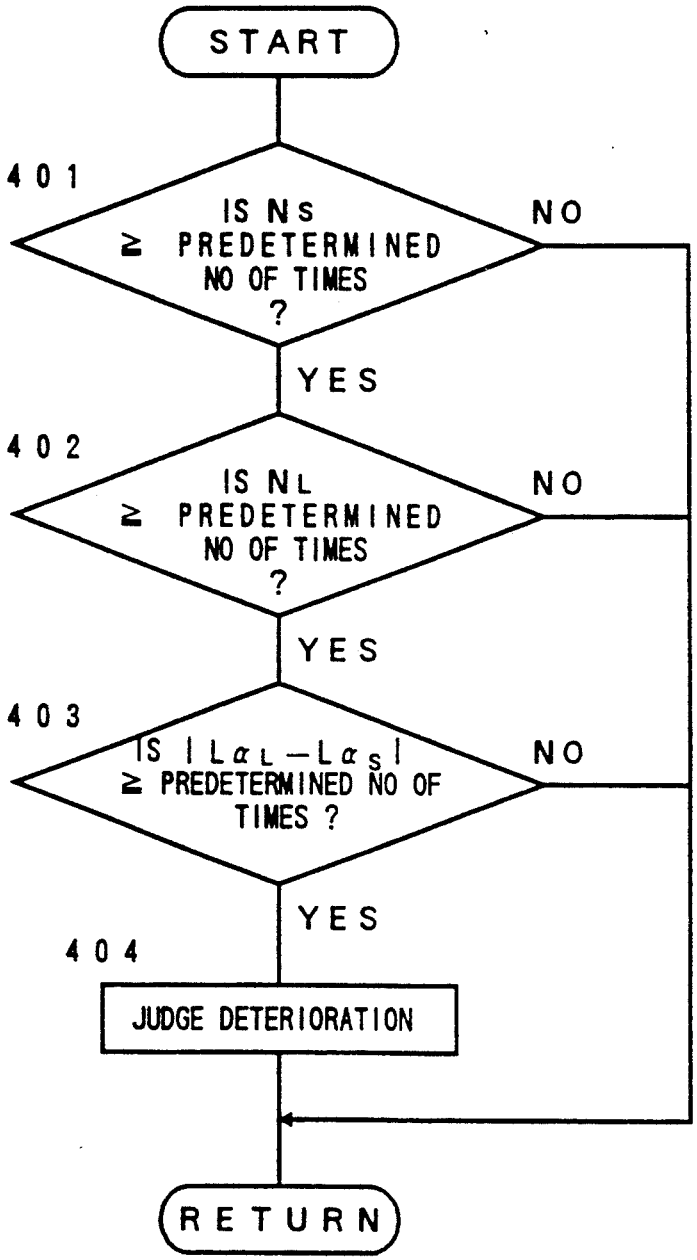
FIG. 9 is a flowchart of a deterioration judgement process performed by the control unit.

The control unit 30 also judges whether the AFR sensor 13 has deteriorated, as shown by the flowchart of FIG. 9, based on the learning control coefficients Lα S and Lα L when the engine is controlled at the theoretical AFR and a lean AFR as calculated by the aforesaid procedure.

In steps 401 and 402, it is judged whether or learning at the theoretical AFR and the lean AFR have both been performed a predetermined number of times.

If this condition is satisfied, in a step 403, the absolute value of the difference between the learning control coefficient Lα S at the theoretical AFR and Lα S at the lean AFR is calculated, and if this difference is equal to or greater than a predetermined value, it is judged in a step 404 that the AFR sensor 13 has deteriorated.

Figure 10:
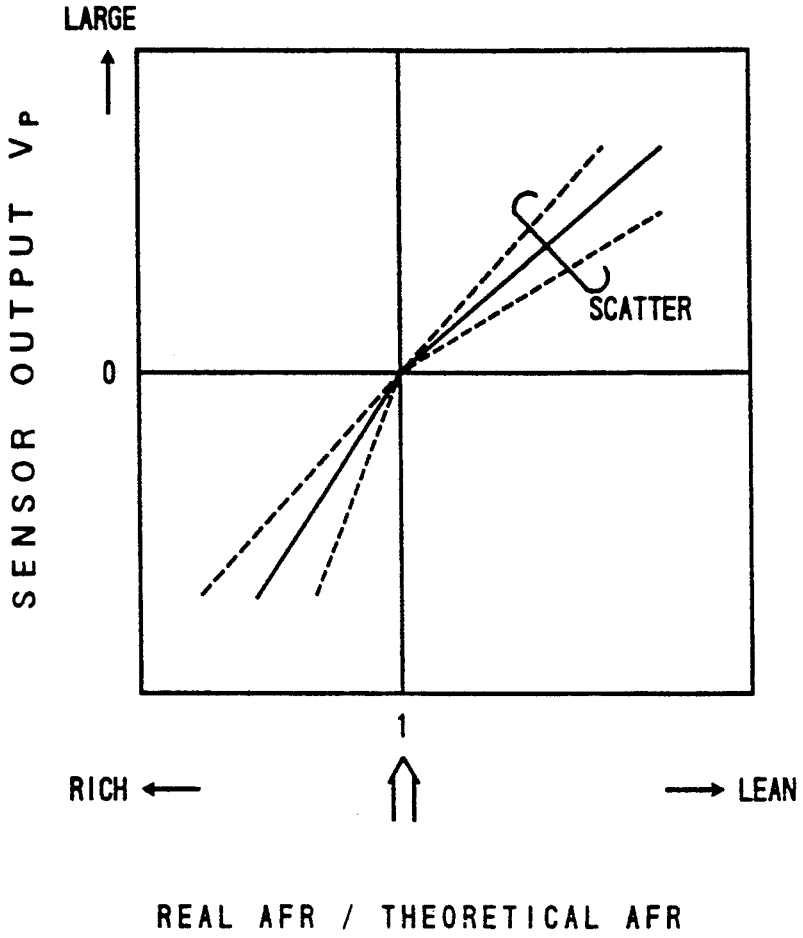
FIG. 10 is a graph showing output characteristics of the AFR sensor.

The output of the AFR sensor 13, as shown in FIG. 10, faithfully follows the chemical composition of the exhaust gas when the engine is running at the theoretical AFR, and there is then very little scatter in the output of the AFR sensor. When not running at the theoretical AFR, the output of the AFR sensor 13 is controlled by gas diffusion in the throughhole 16, and there is then a large scatter in the output.

Thus, if there is scatter in the output of the AFR sensor 13 when the engine is controlled at the theoretical AFR, it is due to scatter or performance deterioration of the fuel injector 4, the air flow sensor 7 or other components.

If however there is scatter in the output of the AFR sensor 13 when the engine is controlled at an AFR other than the theoretical AFR, it may be due either to scatter or performance deterioration of the fuel injector 4 or other components, or to deterioration of the AFR sensor 13.

By comparing the learning control coefficients when the engine is controlled at the theoretical AFR and when it is controlled at another AFR, therefore, it can be precisely determined whether or not the AFR sensor 13 has deteriorated. The aforesaid routines are executed in synchronism with the engine rotation angle.

Using this controller, therefore, AFR control and judging deterioration of the AFR sensor 13 are performed simultaneously.

In the aforesaid embodiment, learning control coefficients were used to determine whether the AFR sensor 13 has deteriorated, but this can also be directly judged from the difference between the average value $\alpha$ SM of the feedback correction coefficient calculated in the step 222 of FIG. 6 and the average value $\alpha$ LM of the feedback correction coefficient calculated in the step 322 of FIG. 8.

The foregoing description of the preferred embodiments for the purpose of illustrating this invention is not to be considered as limiting or restricting the invention, since many modifications may be made by those skilled in the art without departing from the scope of the invention.

The embodiments of this invention in which an exclusive property or privilege is claimed are defined as follows:

1. An air-fuel ratio control system for an engine provided with an air-fuel ratio sensor for continuously detecting air-fuel ratio of an air-fuel mixture supplied to the engine over a side range including the theoretical air-fuel ratio, and means for feedback correcting the air-fuel ratio of the air-fuel mixture to a preset target ratio based on the air-fuel ratio detected by said sensor, comprising:

means for setting said target ratio to the theoretical air-fuel ratio, means for setting said target ratio to an air-fuel ratio other than the theoretical air-fuel ratio, means for learning a feedback correction amount corrected by said feedback correcting means, means for computing a learning correction amount based on said learned feedback correction amount, means for correcting the previous air-fuel ratio of the air-fuel mixture based on said learning correction amount, means for judging the deterioration of said sensor based on the difference between the learning correction amount when the target ratio is the theoretical air-fuel ratio, and the learning correction amount when the target ratio is the other air-fuel ratio.

2. An air-fuel ratio control system as defined in claim 1 wherein said learning correction amount computation means determines the learning correction amount based on a deviation of the average value of the feedback correction amount.

* * * * *